US007429141B2

(12) United States Patent
Habatjou

(10) Patent No.: US 7,429,141 B2
(45) Date of Patent: Sep. 30, 2008

(54) APPLICATOR FOR MAKEUP OR BEAUTY CARE PRODUCTS

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 360 days.

(21) Appl. No.: 11/068,792

(22) Filed: Mar. 2, 2005

(65) Prior Publication Data

US 2005/0196219 A1 Sep. 8, 2005

Related U.S. Application Data

(60) Provisional application No. 60/551,826, filed on Mar. 11, 2004.

(30) Foreign Application Priority Data

Mar. 2, 2004 (FR) ..... 04 50413

(51) Int. Cl.
*A46B 11/00* (2006.01)

(52) U.S. Cl. ..... 401/127; 401/126; 401/128; 401/129

(58) Field of Classification Search ..... 401/124–130
See application file for complete search history.

(56) References Cited

U.S. PATENT DOCUMENTS

| | | | | |
|---|---|---|---|---|
| 4,165,755 | A * | 8/1979 | Cassai | 132/218 |
| 4,428,388 | A * | 1/1984 | Cassai et al. | 132/218 |
| 4,717,032 | A * | 1/1988 | Wu | 215/228 |
| 4,961,664 | A * | 10/1990 | Simper | 401/127 |
| 5,137,038 | A * | 8/1992 | Kingsford | 132/218 |
| 5,328,282 | A | 7/1994 | Charrier et al. | |
| 5,556,216 | A * | 9/1996 | Mayesh | 401/127 |
| 5,575,579 | A * | 11/1996 | Joulia | 401/119 |
| 6,026,823 | A | 2/2000 | Gueret | |
| 6,164,857 | A * | 12/2000 | Wolfarth-Brooks et al. | 401/127 |
| 6,309,125 | B1 | 10/2001 | Peters | |
| 2006/0051155 | A1 * | 3/2006 | Delage | 401/127 |

FOREIGN PATENT DOCUMENTS

| | | | |
|---|---|---|---|
| EP | 0209361 | A2 * | 1/1987 |
| GB | 1459859 | | 12/1976 |

* cited by examiner

*Primary Examiner*—Khoa D Huynh
(74) *Attorney, Agent, or Firm*—Oblon, Spivak, McClelland, Maier & Neustadt, P.C.

(57) ABSTRACT

A packaging and applicator device which is particularly advantageous for a cosmetic product. The arrangement includes a container incorporating an aperture and a cap intended to close the container aperture. The cap is connected to an applicator by a rod and a resilient means of return. The rod incorporates a first portion having a lengthwise axis. In one example, the applicator is connected by a pivot zone to the first portion, and the resilient means of return is arranged so as to constrain the pivot zone such that the applicator is caused to form a non-zero angle relative to the lengthwise axis.

28 Claims, 4 Drawing Sheets

APPLICATOR FOR MAKEUP OR BEAUTY CARE PRODUCTS

CROSS REFERENCE TO RELATED APPLICATIONS

This document claims priority to French Application Number 04 50413, filed Mar. 2, 2004 and U.S. Provisional Application No. 60/551,826, filed Mar. 11, 2004, the entire contents of which are hereby incorporated by reference.

FIELD OF THE INVENTION

The invention provides a device for packaging and applying a product by using an applicator. The applicator preferably includes a rod connected to a cap, with the cap being capable of being mounted on the container in a closed position in which the applicator extends inside the container. The arrangement is particularly suitable for use in the application of make-up or beauty care products, such as for example mascara, eyeliner, eye shadow, nail varnish, or lip color.

BACKGROUND OF THE INVENTION

DISCUSSION OF BACKGROUND

Typical applicators are mounted in alignment with a mounting rod, with the mounting rod in alignment with the cap. This rigid configuration makes the device difficult to manipulate in some instances, particularly when applying make-up to the corner of the eye and eyelid, and more particularly when a right-handed person applies make-up to the left eye, which requires the user to contort her wrist in an uncomfortable manner. Moreover, the ergonomically inefficient nature of these manipulations is conducive to imprecise and faulty application.

Furthermore, when opening packaging devices fitted with such applicators, the users perform a circular movement with their hands rather than linear. The consequence of this natural gesture is to impart a twisting motion to the linear rod, which can lead to irreversible deformation and embrittlement of the rod. In addition, the applicator is not wiped in the same manner over its entire application surface as it passes across the wiper element. This can be particularly disadvantageous for applicators having convex contours, for which the wiping action is naturally less effective.

U.S. Pat. No. 5,328,282 describes known make-up applicators wherein the rod carrying the applicator is composed of two half-rods connected together by a hinge to enable such an applicator and rod assembly to be inserted into a shallow container. However, it is not easy to re-insert such an assembly into the container when it is in an inclined position about its hinge, and the rod has a tendency to give way or yield under the applied pressure.

U.S. Pat. No. 6,026,823 describes a known packaging and applicator device incorporating a rod connected by a ball joint inside the cap. The action required to open such a device is similar to the natural gesture describing a curve referred to above. However, such a device nevertheless poses a problem in that the opening action is broken down into several separate movements combining linear and curved trajectories. The user first pulls on the cap so as to bring the applicator to a position just below the wiper element. The user then imparts a pivot action to the cap relative to the container, which causes the rod to become braced in a position across the neck. By continuing the pivot action, the ball joint is displaced in its seating until the rod presents a desired angular position relative to the cap. Finally, the user applies a final pull to withdraw the applicator from the container. During this final pull, the user also runs the risk of losing the angular position thus obtained, particularly when the applicator passes across the wiper element.

In the current art, there is a need for a device having an action closer to the natural gesture, or in other words, which is more comfortable or convenient to use. There is also a need for an advantageous applicator element oriented at a non-zero angular position relative to a cap to which it is connected.

SUMMARY OF THE INVENTION

The invention provides an arrangement having a novel handling action, particularly for opening and closing such packaging and applicator devices. A preferred example provides a packaging and applicator device for a cosmetic product, particularly make-up, which includes a container having an aperture, and a cap intended to close the container aperture, with the cap being connected to an applicator by a rod and a resilient means of return. The rod has a first portion having a lengthwise axis, and the applicator is connected by a pivot zone to the first portion. In addition, the resilient means of return is arranged so as to constrain the pivot zone such that the applicator is caused to form a non-zero angle relative to the lengthwise axis.

The manipulation of such a device is facilitated in that the resilient means of return automatically imparts a non-zero angular position to the applicator relative to the cap to which said first portion of the rod is connected. As a result, no express manipulation is necessary to obtain this angular position.

By way of example, the pivot zone can be presented by the applicator. As a variant, the pivot zone can also be defined at the junction between the rod and the applicator, or on the rod. In the latter case, the portion of the rod having the lengthwise axis can be arranged on a first side of the pivot zone, and a second portion of the rod can be arranged on a second side relative to the pivot zone to carry the applicator.

Also by way of example, this pivot zone can be a hinge or a ball joint. As a variant, the pivot zone can correspond to a thinning or thinned portion of the rod thickness. In this case, the rod can be obtained, for example, by bi-injection with at least one elastomer material.

Advantageously, the device can include a guide integral with the cap, with the rod extending inside a first recess in this guide so as to allow the applicator to project beyond the guide. Also advantageously, the rod can be movable in the guide. For example, the guide can be arranged so that it is capable of bearing in a leaktight manner on a neck of the container delineating the aperture, particularly when the cap is in the closed position on the container.

In accordance with one example, the guide and the cap can form a second recess to accommodate the resilient means of return, with this second recess being in communication with the first recess. In this case, the two recesses are preferably obtained by molding from a single piece.

Preferably, the guide presents a means of closure capable of engaging with a counterpart means of closure provided on the container.

Preferably, the rod is slidable in the first recess, and the latter is particularly provided to limit the lateral play of the rod.

According to another feature of an example of the invention, the pivot zone can be arranged inside the first recess, so that only the second rod portion, downstream of the pivot zone, projects beyond the first recess. This arrangement also has the advantage that it does not require wiping of the pivot zone. The second rod portion projecting at least partially from the guide can include a ring designed to cooperate with bearing surfaces presented at an inner circumference of the guide so that this second rod portion projects from the guide by extending on an axis forming an angle with the principal lengthwise axis of the guide. In effect, the pivot zone allows this angle to be formed, which can be obtained by pressing the ring against the offset bearing surfaces, and with the pressure being provided by the resilient means of return.

In the case where the bearing surfaces are offset, the ring is then preferably formed orthogonally to the lengthwise axis of the second rod portion, such that if the collar is pressed against these bearing surfaces, it is then arranged in a plane parallel to the plane passing through the bearing surfaces, insofar as the internal space of the guide allows such a position. In this position, the sum of a first angle formed between the second rod portion and the principal lengthwise axis of the guide and a second angle formed between the guide and the plane passing through the offset bearing surfaces can then be equal to 90°.

According to one preferred example, the resilient means of return can be held compressed in the second recess. Thus the resilient means of return is not loose in the second recess, which assists in maintaining the correct position of the rod in its own recess, thus reducing the risks of breakage of the rod when it is in motion relative to the cap.

Also by way of example, in accordance with a feature that can be advantageous for the purpose of manufacturing small devices, when the cap is in the closed position on the container, the applicator can bear against an inner wall of the container, and the resilient means of return can be constrained elastically in response to the engagement of the applicator with the inner wall.

One of the benefits that can be obtained with the present invention is the ability to reduce the dimensions presented by such devices when they are in the closed position, particularly by making the rod retractable inside the device. A further advantage that can be obtained with the invention is that it can provide a leaktight closure of the container, achieved directly by cooperation between the cap and the container aperture, independently of the movement of the rod relative to the cap. To this end, the rod can be first pushed into the cap before making the leaktight closure between the cap and the container. When the applicator is inserted into the container, it moves downward into the container. As the cap is moved closer to the container, the applicator is pressed against an inner wall of the container, so that the resilient means of return is progressively compressed.

Another benefit that can be obtained with a device according to the invention is that it can dispense with the need to form a collar on the rod. The manufacture of a device according to the invention is therefore simpler and, furthermore, the attachment and subsequent leaktight closure of the container are easier to implement.

The resilient means of return is preferably capable of compressing thereby reducing the height of the assembly formed by the applicator, the rod and the resilient means of return, by a value greater than the manufacturing tolerances of the container, and in particular greater than the internal dimensional tolerances of the container.

Preferably, the applicator can have a compressibility lower than the compressibility of the resilient means of return. Preferably, the resilient means of return is chosen with regard to these different levels of compressibility relative to the axis on which the applicator is engaged in bearing contact against the inner wall. As a result, when the applicator is inserted into the container, the resilient means of return will yield so that the length of the applicator, rod and cap, in total, will be shortened without all of the shortening resulting from compression of the applicator element.

Advantageously, on opening the container, the pressure exerted on the applicator is preferably relaxed and the resilient means of return are configured to move the applicator to an initial position in which an angular difference between the applicator and a lengthwise axis of the cap is different from the angular difference observed in the closed position.

In accordance with one example, the applicator is presented at a first end of the rod. In this example, the resilient means of return can be presented at a second end of the rod, opposite the first end.

In a first embodiment, the resilient means of return can be in the form of a spring. Alternatively, the resilient means of return can be in the form of an elastically deformable membrane. Alternatively again, the resilient means of return can also be in the form of a bellows. In one of the embodiments of the invention, the resilient means of return can be obtained by molding in a single piece with the rod. As should be recognized, the resilient means of return can be provided by any suitable resilient expedient.

By way of example, the applicator can be a twisted brush incorporating a layer of bristles arranged between two branches of wire, with the two branches being respectively twisted into a spiral.

The container in a preferred form holds a cosmetic product. The arrangement can be particularly advantageous for a mascara.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
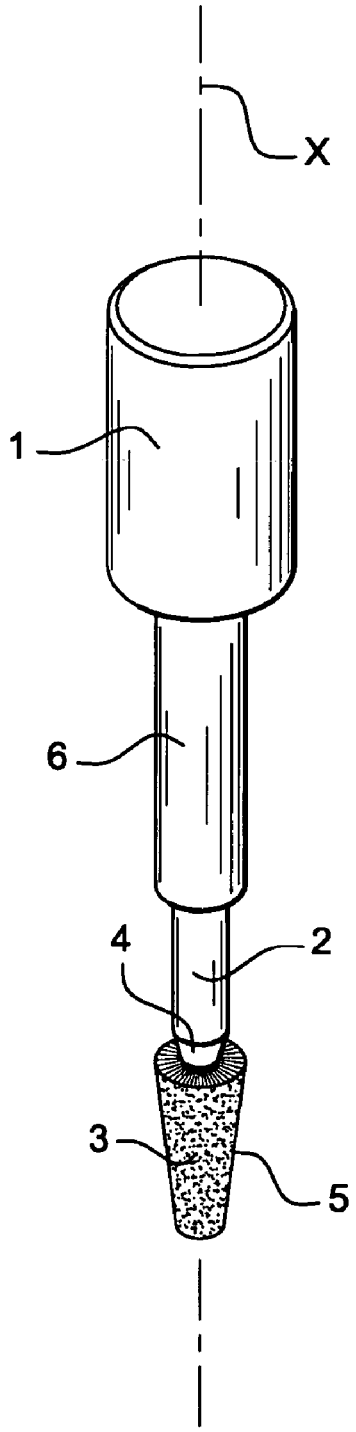
FIG. 1 is a profile or perspective view of a cap carrying an applicator of a device according to the invention.

FIG. 1 shows a cap 1 from which extends a rod 2. At one end 4 of the rod, an applicator 3 is mounted. The cap 1 in the preferred examples serves as a grasping element for the applicator 3. In the example shown, the cap is substantially cylindrical in shape having an axis of rotation also corresponding to a principal lengthwise axis of the cap 1. The rod 2 in this example is centered inside the cap 1, and includes at least one portion extending on a principal lengthwise axis X which in this example is superimposed on the axis of rotation Y of the cap.

As a variant, the cap 1 can have any other shape of aesthetically pleasing or ergonomic design to facilitate grasping of the cap.

By way of example, the applicator 3 is a fitted element attached to the rod 2. Also, by way of example, the applicator 3 is a tuft of bristles held between two metal wires twisted together so that the ends of these wires, sometimes referred to as "brush tails," serve to attach the applicator to the rod. As a variant, the rod 2 can include at least one portion on which the applicator 3 is held, with this portion then being capable of forming a core of the applicator 3. It is for example molded in a single piece with the rod.

The applicator 3 includes an application surface 5 and a lengthwise axis A (shown in FIG. 3) about which this application surface 5 is defined. Where appropriate, the applicator 3 can be mounted so that the axis about which the wires of the brush are twisted substantially corresponds to this lengthwise axis A.

Figure 2:
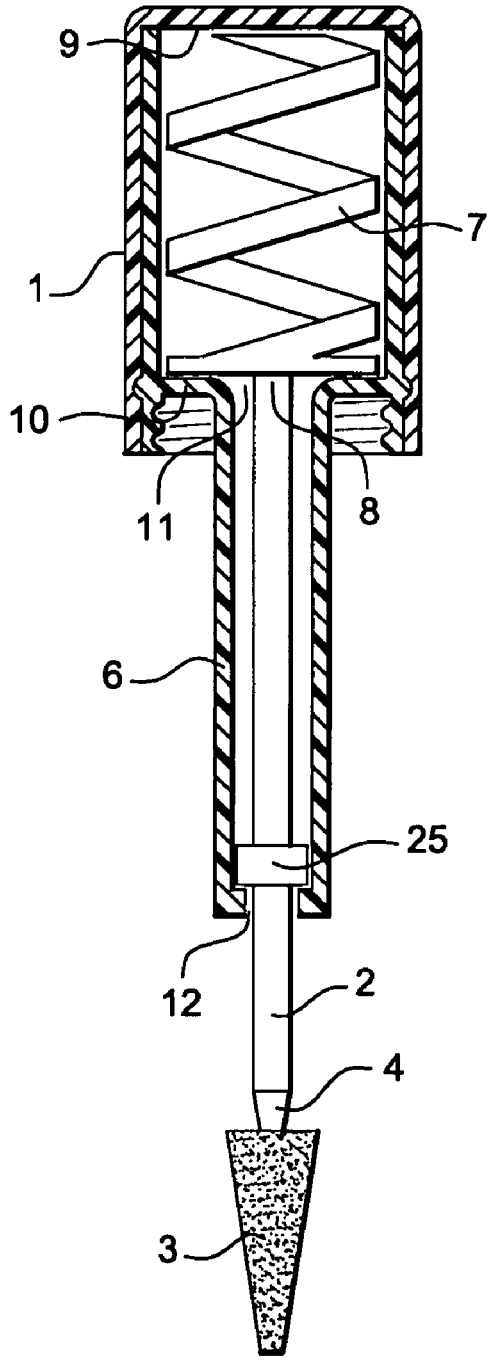
FIG. 2 is a cross-sectional view of a cap carrying an applicator of a device according to the invention.

The cap 1 includes a guide 6, inside of which the rod 2 extends. This guide 6 is integral with (or coupled to) the cap 1. As illustrated in FIG. 2, a resilient means of return 7, in this example a spiral-wound or helical spring, is mounted at a second end 8 of the rod 2. This spring 7 is obtained for example by molding with the rod 2. As a variant, the rod 2 can also include means (not shown) for attachment to an independent spring.

The spring 7 is arranged inside the cap 1 in the illustrated example. In effect, it is compressed between the bottom 9 of the cap 1 and a collar 10 integral with the guide 6. This collar 10 incorporates an opening 11 through which the rod 2 extends. The rod 2 can slide, through this opening 11, inside the guide 6.

In FIG. 2, the applicator 3 is in an initial at-rest position ready for use. In this position, the spring 7 pushes the rod 2 so that it projects to the maximum extent from an outlet aperture 12 in the guide 6. The applicator 3 is then at its maximum distance from the cap 1 which also serves as a grasping element.

Figure 3:
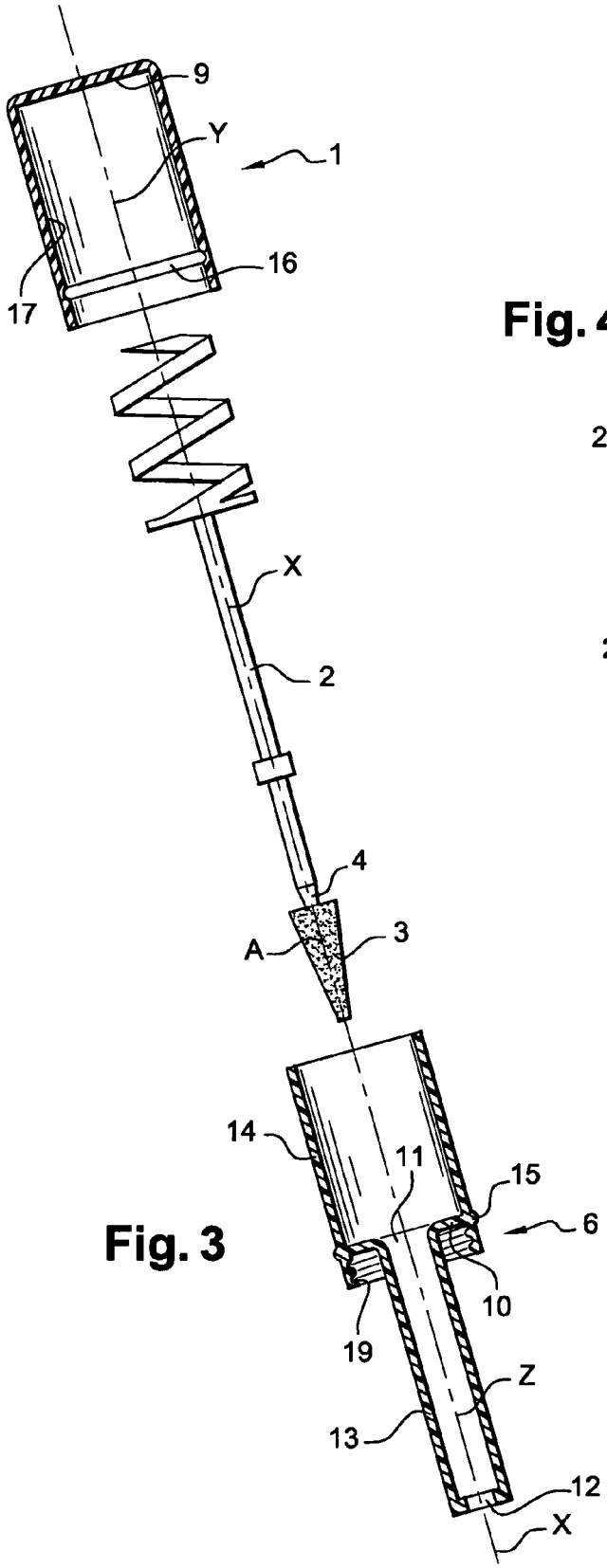
FIG. 3 is an exploded view of a cap carrying an applicator of a device according to the invention in partial cross-section.

As illustrated in FIG. 3, the applicator 3 connected to its rod 2 is first mounted in the guide 6, by first inserting the applicator 3 through the opening 11 and pushing until it emerges at the outlet aperture 12 of the guide 6. Between the opening 11 and the outlet aperture 12, the guide 6 defines a first tubular recess 13, also termed tubular portion 13, extending on an axis Z. In the embodiment shown, the axis Z is superimposed on the axis of rotation Y of the cap 1.

Between the collar 10 and the bottom 9 of the cap 1, a second recess 18 is formed, inside of which the spring 7 is accommodated. For example, walls 14 standing orthogonally to this collar 10 participate in the definition of this second recess 18.

Then, according to this preferred assembly process, the assembly including rod 2, applicator 3, spring 7 and guide 6 is inserted into the cap 1, so that a bead 15 provided on the outer circumference of the guide 6 engages with a counterpart groove 16 on the inner circumference 17 of the cap 1. Cooperation, for example, between the bead 15 and the groove 16 provides a leaktight connection. When thus engaged, the cap 1 then becomes integral with the guide 6. In particular, the dimensions of the second recess 18 are then defined so that the spring 7 is capable of being compressed to a greater or lesser extent in this second recess 18 depending on the axial position of the rod 2 in the guide 6. The dimensions of the spring 7 are chosen so that it cannot move out of this recess 18 via the opening 11.

Preferably, when the spring 7 is placed in the second recess 18, irrespective of the axial position of the rod 2, it is in a compressed state. Cooperation between the bead 15 and the counterpart groove 16 is designed to provide resistance to the pressure exerted on the collar 10 and the bottom 9 by this compressed spring 7.

Means of closure 19 are presented by either the cap 1 or the guide 6 to engage with counterpart means of closure 20 on a container 22 inside which the applicator 3 is intended to be placed. These means of closure 19 and 20 are screw threads for example. In the example shown, the means of closure 19 are presented by the guide 6, and the means of closure 20 are on a neck 21 delineating an opening 60 in the container 22.

Figure 4:
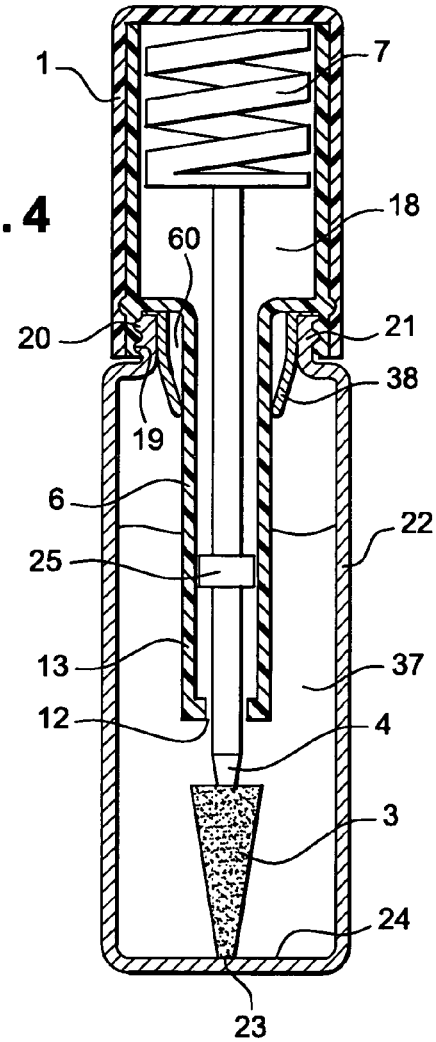
FIG. 4 is a cross-sectional view of a device according to the invention in the closed position.
Figure 5:
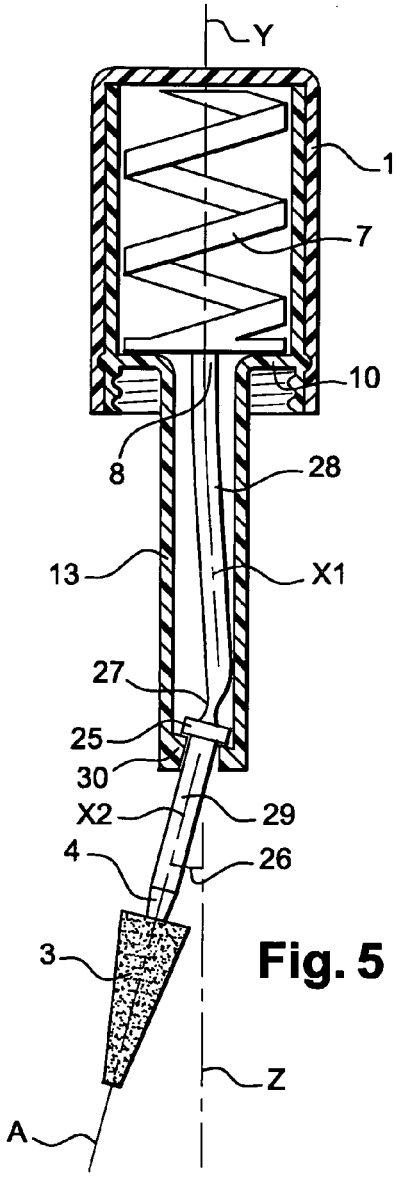
FIG. 5 is a cross-sectional view of a cap carrying an applicator of a device according to a variant of the invention.

As shown in FIG. 4, to close the container 22 with the applicator 3 stored inside, the applicator 3 is inserted into the container 22 until a distal end 23 of the applicator 3 comes into contact with a bottom 24 of the container 22. This bottom 24 includes at least one part defined transversely to the axis of the neck 21. Then, to close the container 22, the cap 1 is moved towards the neck 21 and as soon as the applicator 3 comes into bearing contact against the bottom 24, the rod 2 slides progressively into the guide 6 by virtue of progressive compression of the spring 7.

According to the preferred example, the spring 7 has a compressibility greater than that of the applicator 3, which means that when the applicator 3 is in bearing contact against the bottom 24 of the container 22, the convergence force exerted between the container 22 and the cap 1, the force being exerted in particular on axis Z, first causes the spring 7 to compress before the applicator 3 is compressed. Compression of the applicator 3 can also take place when the compressive capacity of the spring 7 is reached, for example, or where the force to further compress the spring exceeds the force to deform the applicator.

The degree of compression of the spring 7 in its recess 18 is chosen with regard to or considering the dimensional manufacturing tolerances of the rod 2, the applicator 3, and the container 22, together with the assembly tolerances for mounting the applicator 3 on the rod 2 and for fitting the guide 6 into the cap 1, so that the user can exert a controlled and reproducible manual force to obtain engagement of the cap 1 on the container 22. Preferably, provision is made so that the spring 7 does not need to be taken beyond a given degree of compression, below its maximum degree of compression.

When the cap 1 is detached from the container 22, and as they are progressively moved apart, the rod 2 once again slides in the guide 6 under the force of the spring 7 so that the spring is progressively released from the constraint to which it was subjected in the closed position.

The rod 2 is arranged to slide in the guide 6 when the container 22 is closed or opened. In the illustrated example, the rod is fitted with a ring 25 to limit its axial play in the guide 6. For example, the maximum play between axis X of the rod 2 and axis Z of the guide 6 can be less than 10°.

As a variant, as shown in particular in FIGS. 5 to 8, the applicator 3 can be positioned with axis A in an oblique position relative to axis Z of the guide 6. For example, axis A on which the applicator 3 extends forms an angle 26 with axis Z, with this angle 26 being 30° for example. In the example shown, when the applicator 3 is outside the container 22, during use, it is held in this fixed angular position.

In effect, this angular position is obtained by the presence of a pivot zone 27 on the rod 2, with this pivot zone 27 dividing the rod into two portions on either side of the pivot zone 27. A first portion 28 of the rod 2, extending on axis X1, is defined between the pivot zone 27 and the second end 8. A second portion 29 of the rod 2, extending on axis X2, is defined between the pivot zone 27 and the first end 4, with this second portion carrying the ring 25 in the illustrated example.

Under the pressure of the spring 7, the rod 2 and in particular the ring 25 is brought into bearing contact against a surface 30 defined on the inner circumference of the tubular portion 13 of the guide 6. In a first case, such as that shown, the surface 30 defines a bearing plane P (see FIG. 6) forming an angle 31 different from 90° with the axis Z of the tubular portion 13, and the ring 25 makes contact with this surface 30 via a surface 32 defined orthogonally to the axis X2. Thus, when the rod 2 is pushed by the spring 7, the ring 25 is pushed inside the guide 6 until it reaches a stop position against this surface 30. In this position, the surface 32 is then aligned with the plane P. In effect, the pivot zone 27 then permits a degree of bending such that axes X1 and X2 of the two portions 28 and 29 of the rod form an angle between them, and these portions may no longer be aligned with axis Z of the guide 6.

Bending of the pivot zone 27 is limited by the internal space defined within the tubular portion 13. This space is determined in relation to the dimensions of the rod and the ring 25, and in relation to the angle 31 offered between the plane P and axis Z of the guide 6.

Preferably, the outlet aperture 12 through which the second portion 29 extends from the guide 6 includes at least one wall orthogonal to the plane P to limit the angular position assumed by the second portion 29.

As a variant, not shown, the surface 30 defined on the inner circumference of the tubular portion 13 of the guide 6 can be orthogonal to axis X, and the angular orientation can be provided or assisted via the surface 32 of the ring 25 that comes into contact with this surface 30, with the surface 32 forming an angle different from 90° with respect to axis X2 of the second portion 29. An angular position of the second portion 29 relative to axis Z can also be obtained in this way.

In the embodiments illustrated, the applicator 3 is mounted in a fixed position on the end 4 of the second portion 29. In fact, changes in the angular position of axis A of the applicator 3 relative to axis Z of the guide 6 are of the same amplitude and in the same direction as changes in the angular position of axis X2 of the second portion 29 relative to this same axis Z. In the embodiments illustrated, axis A of the applicator 3 is superimposed on axis X2 of the second portion 29. As a variant, the applicator 3 can be mounted at the end 4 so that axis A is intersecting relative to axis X2.

Figure 7:
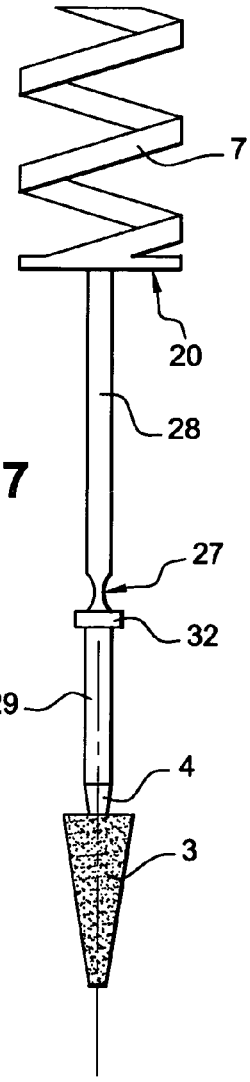
FIG. 7 is a profile view of a first alternative embodiment of an applicator connected to a rod and a resilient means of return of a device according to the invention.
Figure 6:
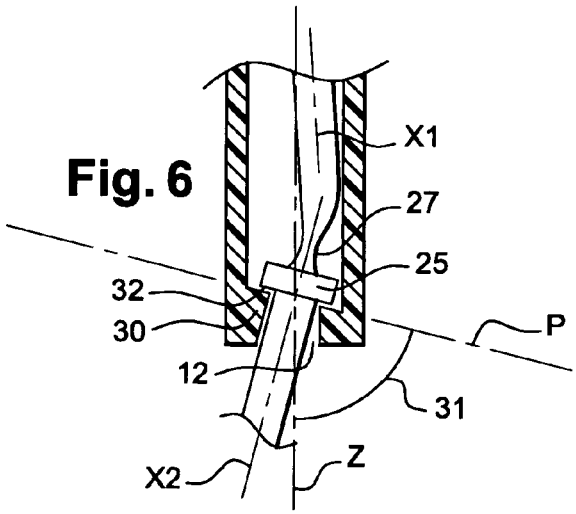
FIG. 6 is a partial enlarged view of FIG. 5.

In a first particular embodiment, depicted in FIG. 7, the pivot zone 27 can be obtained by a thinning of the rod 2. For example, the rod can be produced by bi-injection to incorporate a core made of an elastically deformable material surrounded by a sheath made of a rigid material. At the pivot zone 27, the sheath can, for example, be removed so that only the core is visible and capable of accommodating the bending movements imposed by the action of the spring and due to the respective angular positions of the bearing surfaces 30 and the surface 32.

Preferably, and by way of example, in this case, the rod 2 and the spring 7 can then be made together by molding in a single piece. For example, they can be molded from expanded or non-expanded thermoplastic materials, including acrylic or cellulose derivatives, polycarbonates, polyamides, styrenes, polyolefins, vinyls, homopolymer polyethylene terephthalate, and/or mixtures of these materials in variable proportions. As noted earlier, the pivot zone can also or alternatively be associated with the applicator, or at a juncture between the applicator and the rod.

Figure 8:
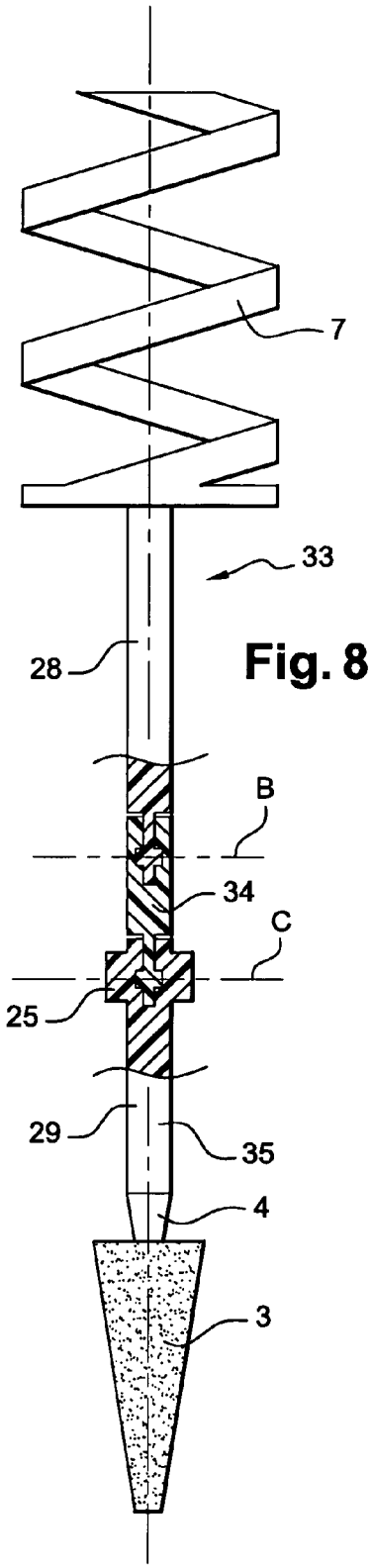
FIG. 8 is a profile view of a second alternative embodiment of an applicator connected to a rod and a resilient means of return of a device according to the invention.
Figure 9:
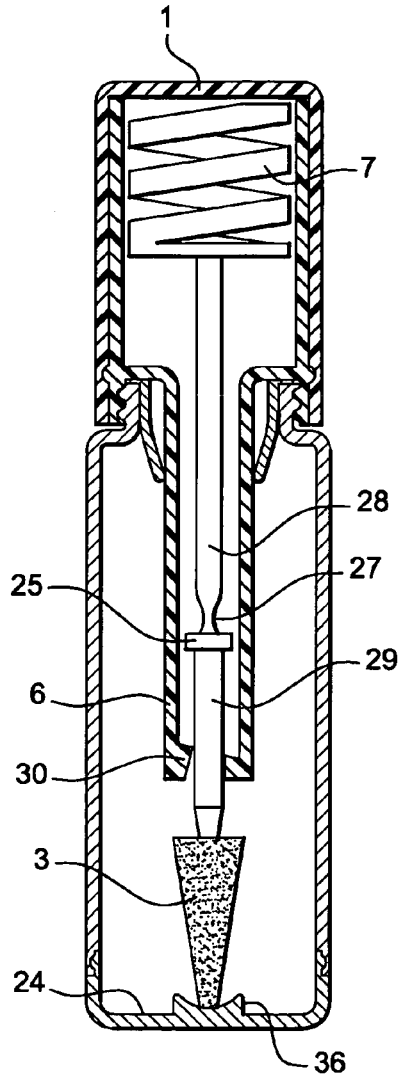
FIG. 9 is a cross-sectional view of a device according to another variant of the invention in the closed position.

In a second particular embodiment, depicted in FIG. 8, the pivot zone 27 can be obtained by assembling a first unit 33 formed by the first portion 28 and the spring 7, with a second unit 34. This second unit 34 can itself be attached to a third unit 35 formed by the second portion 29 of the rod presenting the ring 25, and carrying the applicator 3. The first unit 33 is then, for example, pivoted on the second unit 34 by means of a hinge rotating about a first axis of rotation B. In this example, and in a similar manner, the second unit 34 is pivoted on the third unit 35 by means of a second hinge rotating about a second axis of rotation C. The units are preferably molded from expanded or non-expanded thermoplastic materials, including acrylic or cellulose derivatives, polycarbonates, polyamides, styrenes, polyolefins, vinyls, homopolymer polyethylene terephthalate, and/or mixtures of these materials in variable proportions.

The hinges can for example be made by snapping a pair of bosses presented by one of the units into two counterpart cavities presented by other of the two units. In the example illustrated in FIG. 8, the axes of rotation B and C are mutually parallel.

Irrespective of the manner in which the rod 2 is configured, with or without pivot zone 27, it can be accommodated in a shallow container by virtue of the fact that compression of the spring 7 allows the rod 2 to move along the guide 6. When the second portion 29 moves along the guide 6, given the internal configuration of the guide 6, the pivot zone 27 allows a new angular position between axes X1 and X2. For example, the pivot zone 27 reverts to a non-deformed position when the rod 2 moves along the guide 6. The second portion 29 is then displaced along the axis Z. To this end, the bottom 24 can include an indentation 36 forming, for example, an inclined surface such that the applicator is able to bear against this indentation 36 at a first level, and such that, progressively, under the compression of the spring 7 and the movement of the second portion of the rod 29 in the guide 6, the applicator 3 describes a rotational movement on an arc of circle until it reaches a position of alignment between axis A and axis Z. By way of example, the bottom 24 can be attached to the walls of the container 22, for example, by welding. It is to be understood that the location of the pivot zone can vary.

This indentation 36 provided at the bottom 24 is for example curved in shape, for example hemispherical, such that the applicator 3, even in its maximum angular position relative to the axis Z, is able to bear against an inclined surface of this indentation 36. Preferably, the distal end 23 of the applicator 3 is capable of sliding against this inclined surface.

In the various embodiments of the invention, the applicator 3 is a twisted brush, preferably of dimensions adapted for the application of a cosmetic product to the eyelashes. In a particularly preferred form, the container 22 holds a product 37 such as a mascara. The neck 21 of the container 22 is preferably fitted with a wiper element 38 designed to wipe at least the outer circumference of the tubular part 13 of the guide 6 which is inserted within the container 22. In addition, the outlet aperture 12 can also be provided with a wiper lip (not shown) to prevent the product from penetrating into the guide. This lip can be mounted on the outlet 12, or can be obtained directly by molding with the guide 6.

In the closed position, leaktight closure of the cap 1 on the container 22 is obtained for example by a bearing collar 39 of the wiper element 38 mounted in the neck 21 being resiliently squeezed against the collar 10 presented by the guide 6 integral with the cap 1.

Throughout the description, the expressions such as "including," "including one," "having," "has" or "comprising" should be regarded as synonymous with "including at least one," unless otherwise specified.

Obviously, numerous modifications and variations of the present invention are possible in light of the above teachings.

It is therefore to be understood that, within the scope of the appended claims, the invention may be practiced otherwise than as specifically described herein.

What is claimed as new and desired to be secured by Letters Patent of the United States is:

1. A packaging and applicator device for a cosmetic product, including:

a container having an aperture;

a cap intended to close the container aperture, wherein the cap is connected to an applicator by a rod and a resilient means of return, and wherein the rod includes a first portion having a lengthwise axis;

a guide integral with the cap;

wherein the applicator is connected by a pivot zone to said first portion; and wherein the resilient means of return is arranged so as to constrain the pivot zone such that the applicator is caused to form a non-zero angle relative to said lengthwise axis, wherein the guide includes a first recess, and wherein at least part of the rod extends inside the first recess and the applicator projects outside of the guide, wherein the pivot zone is positioned inside the first recess, and wherein the rod includes a second portion that emerges from the guide, and wherein a ring is provided on the second portion and the ring cooperates with bearing surfaces provided at an inner circumference of the guide to cause the non-zero angle.

2. A device according to claim 1, wherein the pivot zone is associated with the applicator.

3. A device according to claim 1, wherein the pivot zone is defined at a junction between the rod and the applicator.

4. A device according to claim 1, wherein the first portion of the rod is arranged on a first side of the pivot zone, and wherein the rod includes a second portion arranged on a second side relative to the pivot zone.

5. A device according to claim 1, wherein the pivot zone includes a hinge.

6. A device according to claim 1, wherein the pivot zone is formed by a thinned portion of the rod.

7. A device according to claim 1, wherein a second recess is formed between the cap and the guide, and wherein the second recess accommodates the resilient means of return, and wherein the second recess is in communication with the first recess.

8. A device according to claim 7, wherein the guide is molded as a single piece.

9. A device according to claim 7, wherein the pivot zone is positioned inside the first recess, and wherein the rod includes a second portion that emerges from the guide, and wherein a ring is provided on the second portion and the ring cooperates with bearing surfaces provided at an inner circumference of the guide.

10. A device according to claim 9, wherein the resilient means of return is held in a compressed state in the second recess.

11. A device according to claim 1, wherein the guide bears in a leaktight manner on a neck of the container delineating the aperture when the cap is positioned on the container to close the aperture.

12. A device according to claim 1, wherein the guide includes a means of closure designed to engage with a counterpart means of closure on the container.

13. A device according to claim 1, wherein when the cap is in a closed position on the container, the applicator bears against an inner wall of the container, and wherein in the closed position the resilient means of return is elastically compressed in response to engagement of the applicator against said inner wall.

14. A device according to claim 13, wherein an amount of force required to axially compress the applicator is greater than an amount of force required to axially compress the resilient means of return.

15. A device according to claim 14, wherein on opening the container, pressure exerted on the applicator is relaxed and the resilient means of return is between the applicator and a lengthwise axis of the cap is different from an angular difference in the closed position.

16. A device according to claim 13, wherein on opening the container, pressure exerted on the applicator is relaxed and the resilient means of return is configured to move the applicator to an initial position in which an angular difference between the applicator and a lengthwise axis of the cap is different from an angular difference in the closed position.

17. A device according to claim 1, wherein an amount of force required to axially compress the applicator is greater than an amount of force required to axially compress the resilient means of return.

18. A device according to claim 1, wherein the applicator is positioned at a first end of the rod.

19. A device according to claim 18, wherein the resilient means of return are positioned at a second end of the rod, opposite the first end.

20. A device according to claim 1, wherein the resilient means of return are in the form of a spring.

21. A device according to claim 1, wherein the resilient means of return are molded as a single piece with the rod.

22. A device according to claim 1, wherein the applicator is a twisted brush, including a layer of bristles arranged between two branches of a wire, and wherein the two branches are respectively twisted into a spiral.

23. A device as recited in claim 1, further including a make-up product in said container.

24. A device as recited in claim 1, further including a mascara product in said container.

25. A device according to claim 1, wherein said applicator is movable between a retracted position and an extended position, and wherein when said cap is mounted on said container to close said container said applicator contacts an inner surface of said container causing compression of said resilient means of return such that said applicator is in the retracted position, and wherein said applicator assumes said extended position when said cap is removed from said container as compression of said resilient means of return is at least partially released.

26. A device according to claim 25, further including a guide, wherein said rod at least partially extends inside of said guide and said resilient means of return is positioned between said guide and said cap, and wherein a first bearing surface is associated with said rod and a second bearing surface is associated with said guide, and further wherein said first bearing surface contacts said second bearing surface when said applicator is in said extended position, and further wherein said first bearing surface is spaced from said second bearing surface when said applicator is in said retracted position.

27. A device according to claim 1, wherein the bearing surfaces provided at the inner circumference of the guide define a bearing plane that is non-orthogonal to an axis of the guide.

28. A device according to claim 1, wherein the bearing surfaces that contact the ring face an interior of the guide so that a bottom surface of the ring contacts the bearing surfaces.

* * * * *